US010712113B1

(12) United States Patent
Hoffman

(10) Patent No.: US 10,712,113 B1
(45) Date of Patent: Jul. 14, 2020

(54) PIECEWISE HELICAL BARREL FLUTING

(71) Applicant: U.S. Government as Represented by the Secretary of the Army, Picatinny Arsenal, Dover, NJ (US)

(72) Inventor: Brian Hoffman, Bloomington, IN (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/525,924

(22) Filed: Jul. 30, 2019

(51) Int. Cl.
*F41A 21/24* (2006.01)

(52) U.S. Cl.
CPC ..... *F41A 21/24* (2013.01)

(58) Field of Classification Search
CPC ..... F41A 21/24
See application file for complete search history.

(56) References Cited

U.S. PATENT DOCUMENTS 1,789,835 A 1/1931 Pederson
2,378,959 A * 6/1945 Vera ..... F41A 21/24 89/14.1
2,755,069 A * 7/1956 Mosby ..... E21B 6/06 173/97
3,345,590 A * 10/1967 Krank ..... H01P 3/14 333/239
3,875,997 A * 4/1975 Newson ..... F28F 1/06 165/110
4,756,677 A * 7/1988 Hribernik ..... B22F 7/062 419/28
6,209,249 B1 * 4/2001 Borden ..... F41A 3/22 42/16
6,324,780 B1 12/2001 Behling
8,025,003 B1 * 9/2011 Saur ..... F41A 21/24 42/76.01
2017/0074612 A1 * 3/2017 Faxon ..... F41A 21/24
2017/0261280 A1 * 9/2017 Glisovic ..... F41A 21/24
2019/0178598 A1 * 6/2019 McMillan ..... F41A 21/48

OTHER PUBLICATIONS

Volquartsen. <https://www.thetruthaboutguns.com/gun-review-volquartsen-snake-fluted-barrel-rifle/>. Oct. 21, 2013. (Year: 2013).*

* cited by examiner

*Primary Examiner* — Gabriel J. Klein
(74) *Attorney, Agent, or Firm* — John P. DiScala

(57) ABSTRACT

A gun barrel with piecewise helical barrel fluting comprises a single start non-stop feature of alternating and intersecting right hand and left hand helical segments. Piecewise helical barrel fluting combines the ease of manufacture of a single start fluting with the improved performance benefits of a multi-start approach, namely increased barrel stiffness and resulting performance with respect to firing accuracy and firing precision.

19 Claims, 12 Drawing Sheets

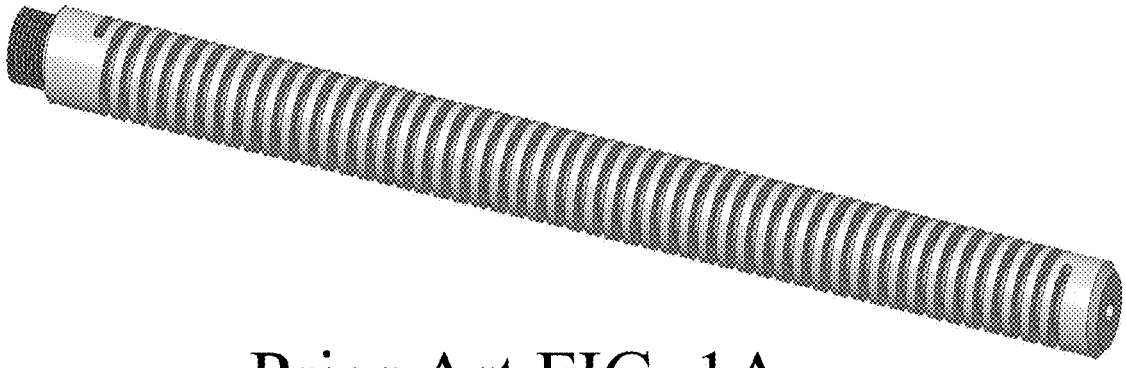
Prior Art FIG. 1A
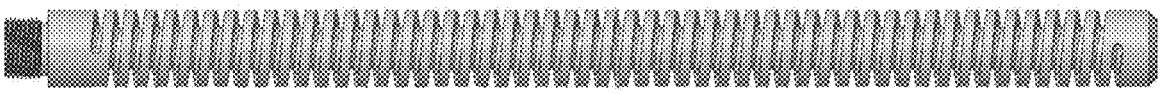
Prior Art FIG. 1B

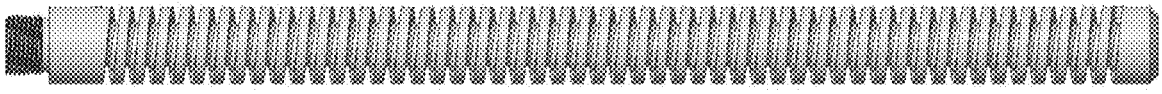
Prior Art FIG. 1C
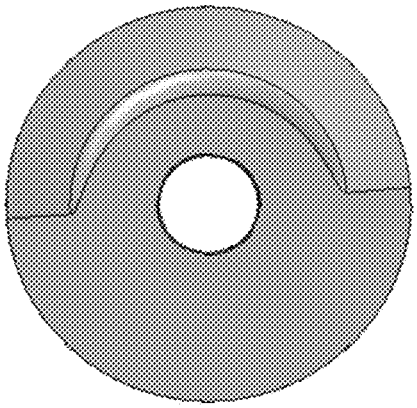
Prior Art FIG. 1D

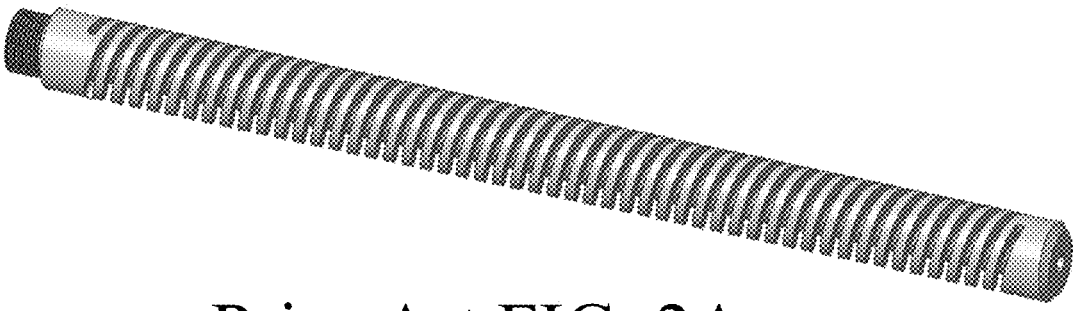
Prior Art FIG. 2A
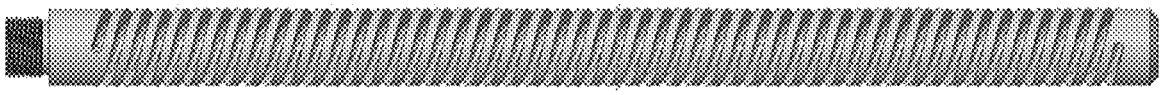
Prior Art FIG. 2B

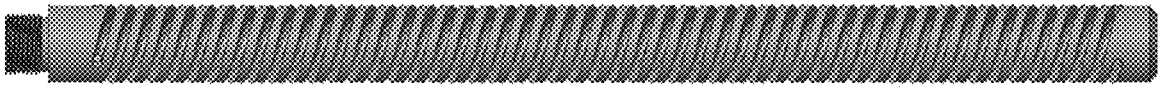
Prior Art FIG. 2C
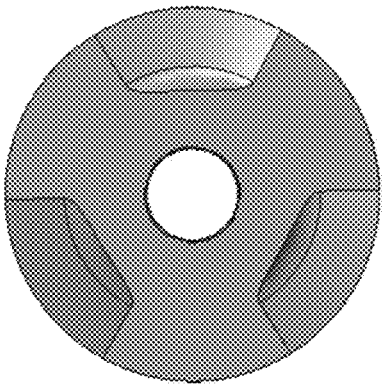
Prior Art FIG. 2D

PIECEWISE HELICAL BARREL FLUTING

STATEMENT OF GOVERNMENT INTEREST

The inventions described herein may be manufactured, used and licensed by or for the United States Government.

FIELD OF THE INVENTION

The invention relates in general to firearms and in particular to fluting of firearms.

BACKGOUND OF THE INVENTION

Gun barrel fluting is a common feature on both military and commercial weapon barrels. Generally, fluting may serve one or more of the following purposes: reduced barrel weight, enhanced barrel heat dissipation, and added decoration for aesthetic purposes.

Depending on the application, the fluting configuration may be designed to address a specific purpose. For example, in a sniper rifle application, weight saving and stiffness properties are important but heat dissipation isn't as critical due to the low firing rate. Discrete longitudinal flutes may be advantageous to meet these needs. Conversely, in high rate of fire machine guns or submachine guns, heat dissipation and barrel cooling are tantamount. As such, discrete radial flutes may be the preferred configuration. Nonetheless, in practice, it is not uncommon to want to concurrently address more than one function with fluting which leads to conflicting strategies for radial verses longitudinal fluting.

Helical gun barrel fluting helps bridge the gap between the conflicting functional priorities of weight savings, stiffness characteristics, and heat dissipation. Helical gun barrel fluting is a continuous feature along the longitudinal axis of the gun barrel thereby achieving some of the stiffness results of discrete longitudinal fluting. In addition, proper selection of the helix angle and groove dimensions also allow for improved heat dissipation characteristics that approach what is achievable through discrete radial fins.

Helical fluting at its most basic involves a single continuous helical feature around the exterior of the gun barrel, single start helical fluting. Prior Art FIGS. 1A-1D shows an isometric view, a top view, a side view and a circular cross sectional view of single start helical fluting on a gun barrel. In terms of stiffness related properties, multi-start helical fluting improves on single start helical fluting by employing multiple parallel continuous features around the exterior of the gun barrel. Prior Art FIGS. 2A-2D shows an isometric view, a top view, a side view and a circular cross sectional view of multi-start helical fluting on a gun barrel. Multi-start helical fluting allows for an equivalent weight savings compared to single start helical fluting while also improving the section modulus and natural frequency characteristics. This is achieved by increasing the helix angle of each individual helical feature to create a larger overall lead distance.

There are downsides to multi-start helical fluting, however. Multi-start helical fluting adds complexity and cost with regard to manufacture and inspection due to the individual helical features requiring timed operations, or relative radial position control.

A need exists for single groove barrel fluting that mimics the stiffness related advantages of conventional multi-start helical fluting while also offering comparable weight savings.

SUMMARY OF INVENTION

One aspect of the invention is a gun barrel which includes an open ended hollow cylinder extending along a longitudinal axis. The open ended hollow cylinder has an exterior surface. The exterior surface defines a single start, non-stop feature centered around the longitudinal axis. The feature further comprises at least at least one transition from a helical first handedness to a helical second handedness.

Another aspect of the invention is a gun barrel for a small caliber weapon system. The gun barrel includes an open ended hollow cylinder extending along a longitudinal axis. The open ended hollow cylinder has an exterior surface. The exterior surface defines a single helical groove centered around the longitudinal axis. The single start, non-stop groove further comprises a continuous plurality of helical segments of alternating handedness. The plurality of helical segments alternate from a first handedness to a second handedness along a first line on the exterior surface which is parallel to the longitudinal axis and alternate from a second handedness to a first handedness along a second line on the exterior surface which is parallel to the longitudinal axis.

A third aspect of the invention is a breech bolt for use with a gun barrel which includes a cylindrical body extending along a longitudinal axis. The cylindrical body has an exterior surface. The exterior surface defines a single start, non-stop feature centered around the longitudinal axis. The feature further comprises a plurality of segments alternating from a first handedness to a second handedness.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

Prior Art FIG. 1A is an isometric view of a gun barrel with single start helical barrel fluting.

Prior Art FIG. 1B is a top view of a gun barrel with single start helical barrel fluting.

Prior Art FIG. 1C is a side view of a gun barrel with single start helical barrel fluting.

Prior Art FIG. 1D is a circular cross-sectional view of a gun barrel with single start helical barrel fluting.

Prior Art FIG. 2A is an isometric view of a gun barrel with multi-start helical barrel fluting.

Prior Art FIG. 2B is a top view of a gun barrel with multi-start helical barrel fluting.

Prior Art FIG. 2C is a side view of a gun barrel with multi-start helical barrel fluting.

Prior Art FIG. 2D is a circular cross-sectional view of a gun barrel with multi-start helical barrel fluting.

DETAILED DESCRIPTION

A gun barrel with piecewise helical barrel fluting comprises a single start non-stop feature of alternating and intersecting right hand and left hand helical segments. Piecewise helical barrel fluting combines the ease of manufacture of a single start fluting with the improved performance benefits of a multi-start approach, namely increased barrel stiffness and resulting performance with respect to firing accuracy and firing precision. In a general sense, stiffer barrels produce more precise shot groups that are more accurately and consistently placed.

Piecewise helical barrel fluting may be employed on barrels of weapon systems of various calibers and types, including small, medium and large caliber weapons. In the embodiments shown in the figures and described below, the piecewise helical barrel fluting is shown in the context of a machine gun barrel. For example, the barrel may be for a M240 machine gun. However, piecewise helical barrel fluting is not limited to machine guns and may be employed on other small caliber weapon systems, such as automatic rifles and sniper rifles. Further, the helical barrel fluting is not limited to use on gun barrels and may be employed on other cylindrical bodies in which weight savings, heat dissipation and increased stiffness are desirable. For example, one embodiment comprises a rifle employing a breech bolt having helical barrel fluting of the type described herein.

Figure 3:
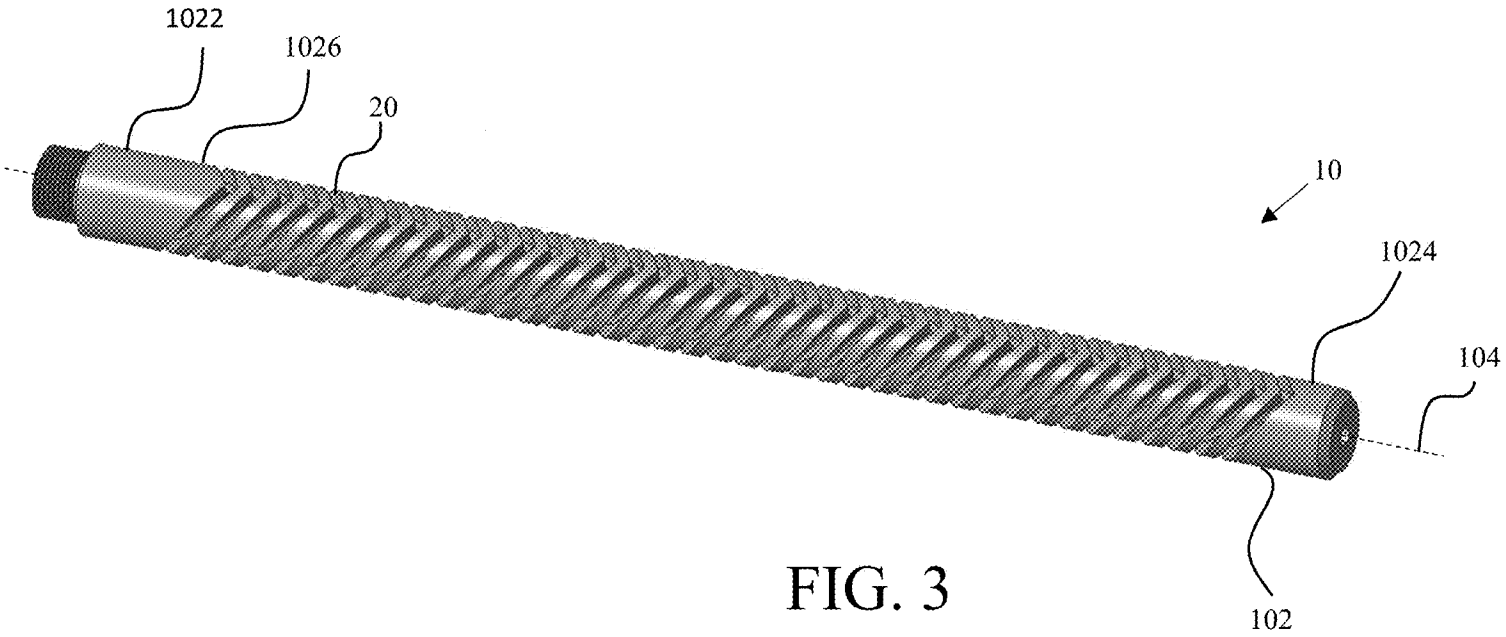
FIG. 3 is an isometric view of a gun barrel with piecewise helical barrel fluting, according to an illustrative embodiment.

FIG. 3 is an isometric view of a gun barrel with piecewise helical barrel fluting, according to an illustrative embodiment. The gun barrel 10 has an open-ended hollow cylindrical body 102 centered around a central longitudinal axis, represented by dotted line 104, and which further comprises a bore end 1022, a muzzle end 1024 and an exterior surface 1026. The exterior surface 1026 defines a piecewise helical barrel feature 20.

Figure 4:
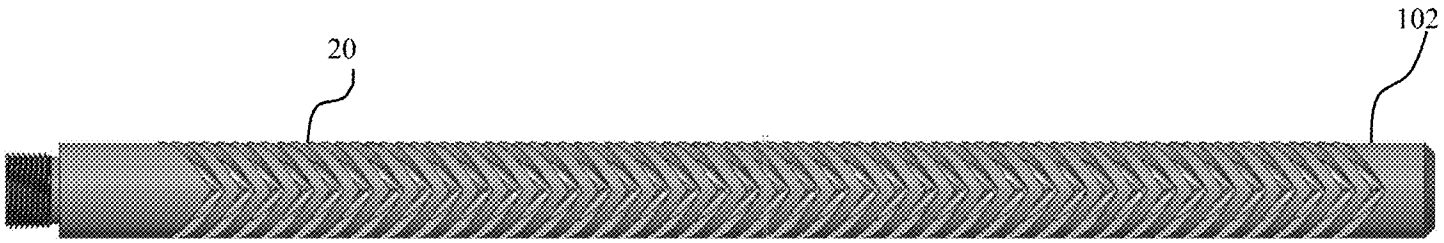
FIG. 4 is a top view of the gun barrel with piecewise helical barrel fluting, according to an illustrative embodiment.

FIG. 4 is a top view of the gun barrel with piecewise helical barrel fluting, according to an illustrative embodiment.

Figure 5:
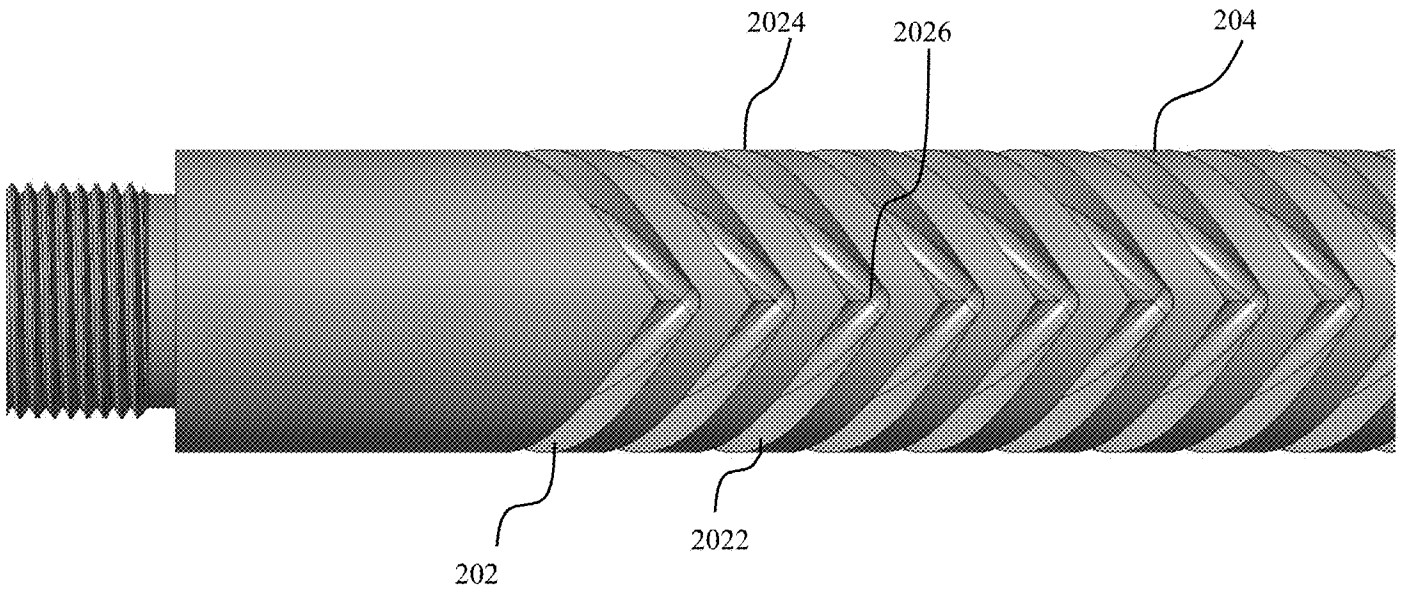
FIG. 5 is a magnified top view of a portion of the gun barrel with piecewise helical barrel fluting, according to an illustrative embodiment.

FIG. 5 is a magnified top view of a portion of the gun barrel with piecewise helical barrel fluting, according to an illustrative embodiment.

Figure 6:
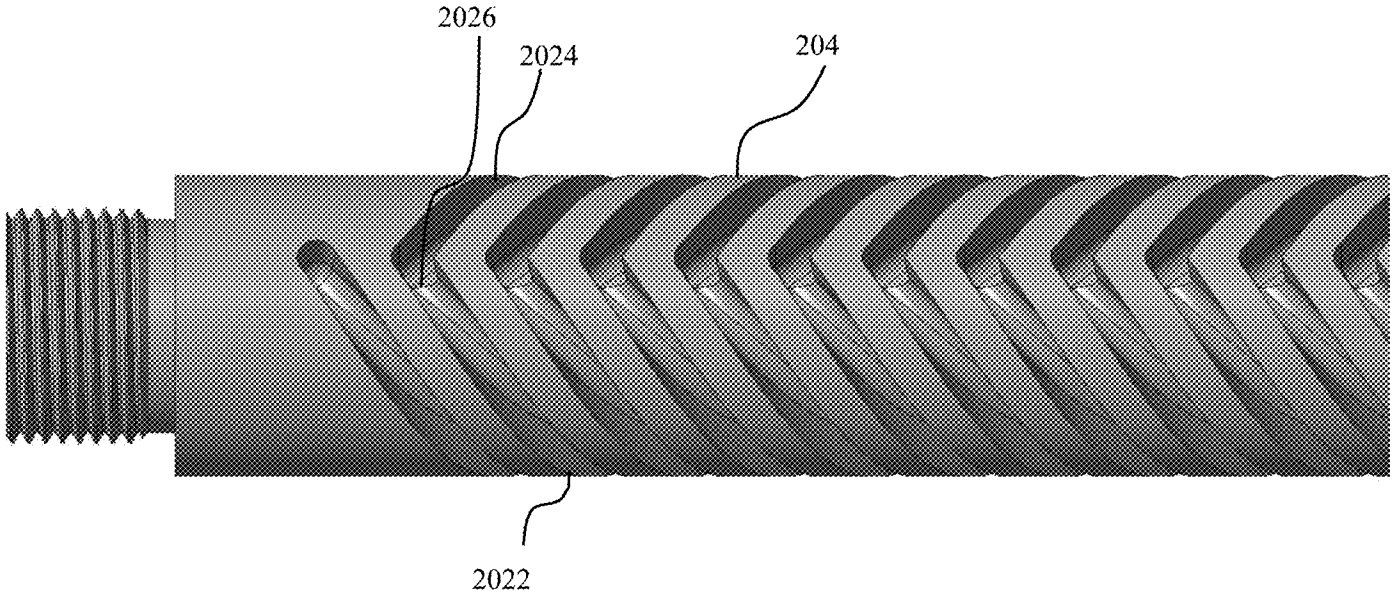
FIG. 6 is a magnified bottom view of a portion of the gun barrel with piecewise helical barrel fluting, according to an illustrative embodiment.

FIG. 6 is a magnified bottom view of a portion of the gun barrel with piecewise helical barrel fluting, according to an illustrative embodiment.

Figure 7:
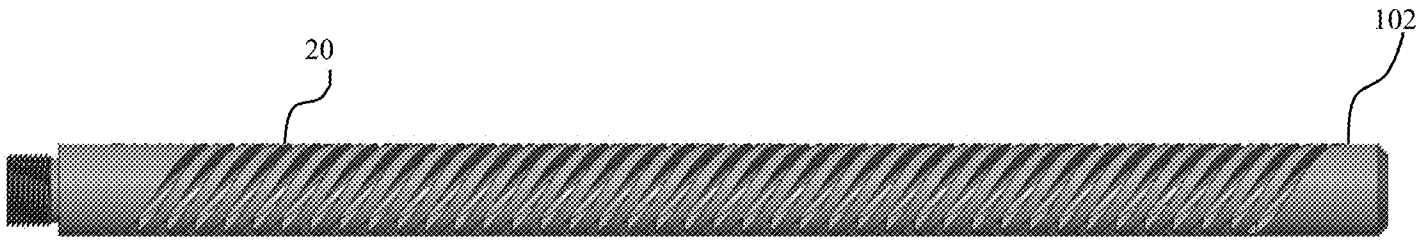
FIG. 7 is a right side view of a gun barrel with piecewise helical barrel fluting, according to an illustrative embodiment.

FIG. 7 is a right side view of a gun barrel with piecewise helical barrel fluting, according to an illustrative embodiment.

Figure 8:
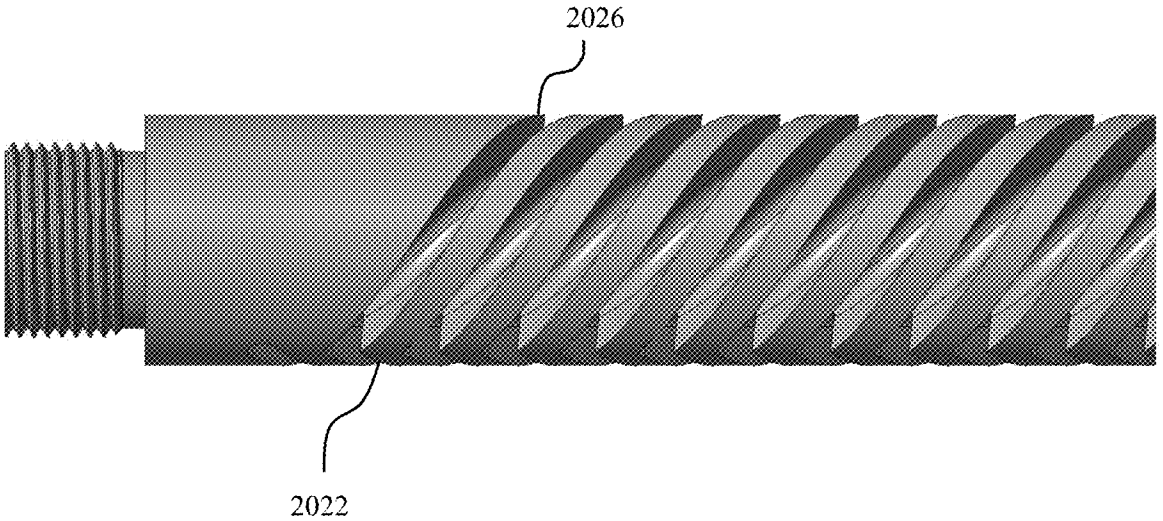
FIG. 8 is a magnified right side view of a portion of the gun barrel with piecewise helical barrel fluting, according to an illustrative embodiment.

FIG. 8 is a magnified right side view of a portion of the gun barrel with piecewise helical barrel fluting, according to an illustrative embodiment.

The piecewise helical barrel feature 20 comprises a single start non-stop groove 202, or fluting, of alternating and intersecting right hand helical segments 2024 and left hand helical segments 2022. The helical barrel feature 20 begins as a groove segment 2022 with a first handedness, a left handedness in the embodiment shown, At an intersection point 2026 along the barrel, the helical barrel feature 20 abruptly but continuously transitions to a groove segment 2024 having a second handedness, a right handedness in this embodiment. At another intersection point 2026 along the barrel 10, the helical barrel feature 20 abruptly but continuously transitions back to the first handedness. The helical barrel pattern continues alternating back and forth between first handedness segments 2022 and second handedness segments 2024 along the longitudinal axis of the gun barrel 10.

In the embodiment shown, the intersection points 2026 from first handedness segments 2022 to second handedness segments 2024 are aligned along a longitudinal line running from the bore end 1022 to the muzzle end 1024 near the top of the cylinder 102. Similarly, the intersection points 2026 from second handedness segments 2024 to first handedness segments 2022 are aligned along a longitudinal line running from the bore end 1022 to the muzzle end 1024 near the bottom of the cylinder 102. As will be described below, in the embodiment shown, the intersection points 2026 are positioned to ensure that each segment comprises an equal pitch magnitude and an equal land width. However, in other embodiments, the intersection points 2026 may be aligned along longitudinal lines that are located at other locations on the exterior surface 1026 of the cylinder 102, closer to each other or at 180 degrees apart or along lines that may not be parallel to the central longitudinal axis 104.

While not a requirement, in an embodiment, each right hand helical segment 2024 and left hand helical segment 2022 is of equal pitch and cross-sectional geometry. In addition, while also not required, in an embodiment, the length of each right hand helical segment 2024 and left hand helical segment 2022 varies slightly so as to form constant width lands 204, the material between successive grooves, as the feature 20 progresses along the longitudinal axis of the gun barrel 10.

The piecewise helical feature 20 can be implemented via CNC machining or forming operations used during conventional barrel fabrication. The feature 20 can be concurrently implemented during the processes of new barrel fabrication or it can be added retroactively to existing barrels. In addition, this feature 20 may be included as part of an additive manufacturing process.

The optimal implementation will necessarily vary according to application. Accordingly, the exact cross sectional profile, segment pitch, segment length, root diameter profile, and limits of axial location for the piecewise helical feature 20 would have weapon-specific and potentially barrel-specific defined characteristics. These characteristics would be dependent on the priority of performance factors such as accuracy, precision, heat dissipation and weight savings. They would also be dependent on barrel structural integrity requirements as derived from the operational internal bore pressures, thermal loading scenarios and material properties.

While the examples of the piecewise helical feature 20 are shown to be integrally created within the gun barrel 10, the feature 20 may also be applied as an add-on feature via a barrel jacket or through additive manufacturing processes. The helical feature 20, to include the lands 204 between the grooves 202, is not limited to the particular material used in the radial portion of the gun barrel 10 in direct contact with the bullet as it travels down the barrel bore.

Figure 9:
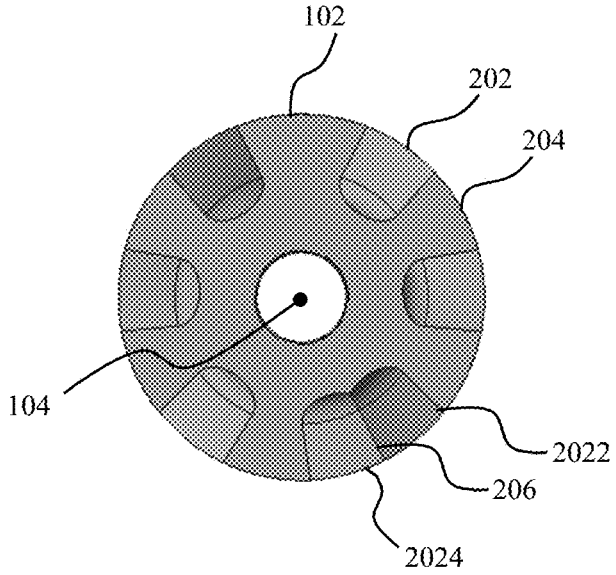
FIG. 9 is a circular cross-sectional view of a gun barrel with piecewise helical barrel fluting, according to an illustrative embodiment.

FIG. 9 is a circular cross-sectional view of a gun barrel with piecewise helical barrel fluting, according to an illustrative embodiment. To evaluate the stiffness related benefits of the helical barrel fluting, the principle area moment of inertia values are examined from a cross section taken normal to the longitudinal axis of the barrel 10. In this particular example embodiment, each normal cross section taken along the length of the helical feature 20 will have the same principal area moment of inertia values because the barrel outer diameter, helical groove root diameter and helical cross section are all constant along the barrel axis.

Accordingly, a higher principal area moment of inertia value is generally more preferable to a lower principal area moment of inertia value. In addition, individual principal values that are equal or close in magnitude are also preferable to those that vary. The principal area moment of inertia is an indicator of a barrel's ability to resist deflection under applied loads. Principal area moments are examined because the barrel's ability to resist deflection may not necessarily be uniform in the radial direction despite the fact that a uniform distribution is desirable. A uniform distribution more typically results in normally distributed bullet dispersion about the vertical and horizontal axes relative to the point of aim.

The two individual principal area moment of inertia of the cross section shown in FIG. 9 were determined to be 0.052 inches to the fourth degree (in^4) and 0.057 in^4with an average of 0.055 in^4. These values were compared to the principal area moment of inertia values for analogous gun barrels with single start and triple-start helical barrel fluting to determine the stiffness benefits of the piecewise helical barrel fluting and the piecewise helical barrel fluting was determined to be advantageous over the single start helical barrel fluting and comparable to the triple-start helical barrel fluting.

To ensure an accurate comparison, three representative barrels having equal barrel outer diameters, helical groove diameters and helical cross sections were compared. In addition, the cross-sectional groove and land geometries of all three barrel configurations were equal. A gun barrel of equal dimensions having a single start helical pattern was determined to have individual principal area moment of inertia values of 0.036 in^4and 0.058 in^4for a combined average of 0.047 in^4. A gun barrel of equal dimensions having a triple start helical pattern was determined to have individual principal area moment of inertia values of 0.057 in^4and 0.057 in^4 for a combined average of 0.057 in^4.

As expected, the conventional single start helical fluting not only has the lowest average area moment of inertia among the three fluting geometries but it also has the greatest disparity between the two individual principal area moment of inertia values. Neither attribute is advantageous. The conventional multi-start helical fluting has the greatest average area moment of inertia among the three fluting geometries and it also has individual principal moment of inertia values that are equal in magnitude. These are both advantageous and desirable characteristics in terms of stiffness properties and associated firing accuracy and precision performance. However, the piecewise helical barrel fluting, despite being a single start feature 20, has an average principal moment of inertia which is 96% that of the conventional multi-start fluting. In addition, the variance between the two individual principal area moments of inertia is less than 9%. Taking into account the manufacturing and inspection benefits with the piecewise helical fluting, it presents the most beneficial overall combination of attributes.

Figure 10:
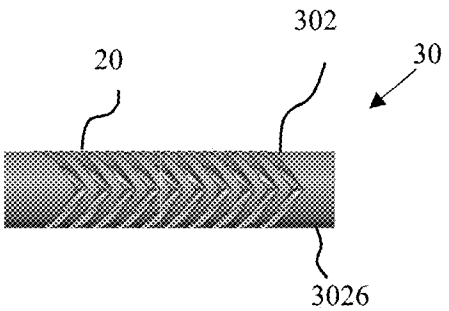
FIG. 10 is a side view of a portion of a breech bolt with piecewise helical barrel fluting, according to an illustrative embodiment.

FIG. 10 is a side view of a portion of a breech bolt with piecewise helical barrel fluting, according to an illustrative embodiment. Piecewise helical barrel fluting is not limited to use on gun barrels and may be employed on other cylindrical bodies in which weight, heat dissipation, and stiffness characteristics are of functional consideration or the aesthetic element of the geometry is desired. In the embodiment shown, the exterior surface 3026 of a cylindrical portion 302 of a breech bolt 30 defines a piecewise helical barrel feature 20.

The breech bolt is for use with a bolt operated weapon such as a rifle. FIG. 10 only shows a cylindrical portion of the breech bolt. However, the breech bolt may further comprise other non-cylindrical portions. The cylindrical portions 302 is a closed right cylinder centered around a central longitudinal axis and which further comprises an exterior surface 3026. The exterior surface 3026 defines the piecewise helical barrel feature 20. The piecewise helical barrel feature is a single start, non-stop feature comprising a plurality of segments alternating from a first handedness to a second handedness.

While the invention has been described with reference to certain embodiments, numerous changes, alterations and modifications to the described embodiments are possible without departing from the spirit and scope of the invention as defined in the appended claims, and equivalents thereof

What is claimed is:

1. A gun barrel comprising:

an open ended hollow cylinder extending along a longitudinal axis having an exterior surface;

said exterior surface defining a single start, non-stop feature comprising at least one transition from a helical groove segment of first handedness and a first direction to a helical groove segment of second handedness and a second direction, wherein said first direction is substantially toward a breech end of the gun barrel and wherein said second direction is substantially toward a muzzle end of said gun barrel.

2. The gun barrel of claim 1 wherein the single start, non-stop feature further comprises at least one transition from a helical groove segment of second handedness and the second direction to a helical groove segment of first handedness and the first direction.

3. The gun barrel of claim 2 further comprising a plurality of transitions from the helical groove segments of first handedness and the first direction to the helical groove segments of second handedness and the first direction and wherein the plurality of transitions are aligned along a first line on the exterior surface parallel to the longitudinal axis.

4. The gun barrel of claim 3 further comprising a plurality of transitions from the helical groove segments of second handedness and the second direction to the helical groove segments of first handedness and the first direction and wherein the plurality of transitions are aligned along a second line on the exterior surface parallel to the longitudinal axis.

5. The gun barrel of claim 4 wherein the helical groove segments of first handedness and the first direction and the helical groove segments of second handedness and the second direction comprise an equal pitch magnitude.

6. The gun barrel of claim 4 wherein the helical groove segments of first handedness and the first direction and the helical groove segments of second handedness and the second direction comprise an equal land width.

7. The gun barrel of claim 1 wherein the feature further comprises a groove created from material added to the exterior surface of the gun barrel.

8. The gun barrel of claim 1 wherein the open ended hollow cylinder further comprises one or more concentric layers.

9. The gun barrel of claim 8 wherein an exterior layer of the one or more concentric layers comprising the exterior surface is a barrel jacket.

10. The gun barrel of claim 8 wherein an exterior layer of the one or more concentric layers comprising the exterior surface is an additively manufactured layer.

11. The gun barrel of claim 1 wherein the gun barrel is a small caliber gun barrel.

12. The gun barrel of claim 1 wherein the feature comprises a groove of uniform geometry.

13. The gun barrel of claim 12 wherein the groove comprises a uniform root radius.

14. The gun barrel of claim 12 wherein the groove comprises a uniform pitch angle.

15. The gun barrel of claim 1 wherein the feature comprises a groove of non-uniform geometry.

16. The gun barrel of claim 15 wherein the groove comprises a non-uniform root radius.

17. The gun barrel of claim 15 wherein the groove comprises a non-uniform pitch angle.

18. A gun barrel for a small caliber weapon system comprising:

an open ended hollow cylinder extending along a longitudinal axis having an exterior surface;

said exterior surface defining a single start, non-stop feature centered around the longitudinal axis and having a uniform pitch magnitude and land width and wherein the feature further comprises a continuous plurality of helical segments of alternating handedness and direction, said plurality of helical segments alternating from a first handedness and a first direction to a second handedness and a second direction along a first line on the exterior surface parallel to the longitudinal axis and alternating from a second handedness and the second direction to a first handedness and the first direction along a second line on the exterior surface parallel to the longitudinal axis, wherein said first direction is substantially toward a breech end of the gun barrel and wherein said second direction is substantially toward a muzzle end of said gun barrel.

19. A breech block for use with a gun barrel comprising:

a cylindrical breech bolt extending along a longitudinal axis having an exterior surface;

said exterior surface defining a single start, non-stop feature comprising a plurality of segments alternating from a first handedness and a first direction to a second handedness and a second direction wherein said first direction is substantially toward a breech face and wherein said second direction is substantially away from the breech face.

* * * * *